United States Patent [19]

Takeda et al.

[11] Patent Number: 4,655,186

[45] Date of Patent: Apr. 7, 1987

[54] METHOD FOR CONTROLLING FUEL INJECTION AMOUNT OF INTERNAL COMBUSTION ENGINE AND APPARATUS THEREOF

[75] Inventors: Yuji Takeda; Katsushi Anzai; Osamu Harada; Toshio Suematsu, all of Toyota, Japan

[73] Assignee: Toyota Jidosha Kabushiki Kaisha, Toyota, Japan

[21] Appl. No.: 767,917

[22] Filed: Aug. 21, 1985

[30] Foreign Application Priority Data

Aug. 24, 1984 [JP] Japan ..... 59-175213
Aug. 25, 1984 [JP] Japan ..... 59-175838

[51] Int. Cl.[4] ..... F02B 3/00

[52] U.S. Cl. ..... 123/480; 123/492; 123/478; 123/422; 123/423

[58] Field of Search ..... 123/492, 478, 480, 493, 123/494, 422, 423

[56] References Cited

U.S. PATENT DOCUMENTS 4,490,792 12/1984 Deutsch et al. ..... 123/492
4,508,084 4/1985 Yamato et al. ..... 123/492
4,508,085 4/1985 Yamato ..... 123/492
4,508,087 4/1985 Yasuoka et al. ..... 123/492
4,508,088 4/1985 Hasagawa et al. ..... 123/492
4,510,911 4/1985 Otube ..... 123/492
4,512,318 4/1985 Ito et al. ..... 123/492
4,520,783 6/1985 Matsushita et al. ..... 123/492
4,548,180 10/1985 Yamato ..... 123/492

*Primary Examiner*—Raymond A. Nelli
*Attorney, Agent, or Firm*—Cushman, Darby & Cushman

[57] ABSTRACT

In a method for controlling a fuel injection amount of an internal combustion engine of the present invention, an incremental fuel amount is calculated in accordance with an engine running condition when a high load state of the engine is detected, and an upper limit value of the incremental fuel amount is gradually increased at predetermined intervals. When the incremental fuel amount is equal to or lower than the upper limit value, the fuel injection amount is increased to the extent of the incremental fuel amount. When the incremental fuel amount exceeds the upper limit value, the fuel injection amount is increased with the upper limit value. With this controlling method, the fuel consumption efficiency and acceleration response can be improved and the generation of knock in the engine can be suppressed during the period of the increase of the fuel injection amount in the high load state.

24 Claims, 19 Drawing Figures

KOTP CALCULATION ROUTINE

400
N≦1500rpm ?
NO
YES
401
402
TRD←0.7+ 0.2xN / 1500
TRD←0.9− (N−1500)x0.4 / 4000
403
TRD≧0.0 ?
NO
YES
TRD←0.0
404
NO
Q/N ≧ TRD ?
405
YES
KOTP3←(Q/N−TRD / 3)X100
407
408
N≦2000rpm ?
NO
YES
410
N<5000rpm ?
NO
YES
409
412
411
KOTP1←1.0
KOTP1←1+ N−2000 / 3000
KOTP1← 2.0
406
KOTP←0.0
KOTP←K OTP1 x KOTP3
413
RETURN

τ CALCULATION ROUTINE

KOTP CALCULATION
900
901
KOTP ≦ 13% ?
NO
YES
904
N ≦ 1000rpm ?
NO
YES
906
N < 5000rpm ?
NO
YES
905
907
908
G ← 5
G ← 5+25 (N-1000)/4000
G ← 30
G ← G×Ctd × 4/1000
909
G ← G + K'OTP
910
911
KOTP ≦ G ?
NO
YES
912
KOTP ← G
0 ← Ctd
902
τ ← Q/N · α · (1+β + KOTP/100)
903
RETURN

METHOD FOR CONTROLLING FUEL INJECTION AMOUNT OF INTERNAL COMBUSTION ENGINE AND APPARATUS THEREOF

BACKGROUND OF THE INVENTION (1) Field of the Invention

The present invention relates to method for controlling a fuel injection amount of an internal combustion engine and an apparatus thereof for increasing a fuel injection amount in a high load state.

(2) Description of the Related Art

In general, in current internal combustion engines, the amount of fuel injected is increased in a high load state so that the air/fuel ratio is controlled to be rich (richer than the power air/fuel ratio at which the maximum power of the engine can be obtained), thereby supressing an increase in the temperature of the exhaust gas. Particularly, in turbo-charged engines, exhaust gas temperatures must be greatly decreased to improve engine durability. Accordingly, the fuel injection amount is usually greatly increased to obtain a rich air/fuel ratio.

However, when the fuel injection amount is increased in the high load state, the fuel consumption efficiency is degraded. In a prior art technique (Japanese Unexamined Patent Publication (Kokai) No. 58-51241) proposed to overcome this drawback, the engine running condition for increasing the fuel injection amount in the high load state is divided into a plurality of regions, and the fuel injection amount is increased for each region after a predetermined delay from the time at which the high load state is detected. This technique utilizes the fact that there is delay between the time when the exhaust temperature is increased and the time when the high load state is detected.

However, in the prior art technique for delaying the increase in the fuel injection amount, the following drawbacks are encountered:

(1) When the load becomes high and the combustion chamber temperature is increased, the engine is prone to knock. Therefore, where the fuel injection amount is not increased during the delay period, there is an undesirable effect on the durability of the engine.

(2) When the air/fuel ratio is too lean, since the exhaust gas temperature is quickly increased and the delay period for increasing the fuel injection amount becomes very short, the fuel consumption efficiency cannot be improved.

(3) During the delay period, since the air/fuel ratio is kept lean, a satisfactory output cannot be obtained, with a resulting poor acceleration response.

SUMMARY OF THE INVENTION

The present invention has been made in consideration of the above situation, and the object of the present invention is to improve the fuel consumption efficiency, to suppress the generation of engine knock, and to improve the acceleration response during the period for the increase of the fuel injection amount in the high load state.

To achieve the above object, according to a basic aspect of the present invention, there is provided a method for controlling the fuel injection amount in an internal combustion engine, comprising the steps of:

detecting a high load state of the engine from the engine running condition, calculating an incremental fuel amount according to the engine running condition after the high load state is detected, gradually increasing the upper limit value of the incremental fuel amount at predetermined intervals, deciding whether or not the incremental fuel amount exceeds the upper limit value, increasing the fuel injection amount to the extent of the incremental fuel amount when the incremental fuel amount does not exceed the upper limit value and increasing the fuel injection amount with the upper limit value when the incremental fuel amount exceeds the upper limit value, and injecting the fuel on the basis of the above increased fuel injection amount.

According to another aspect of the present invention, there is provided a method for controlling the fuel injection amount in an internal combustion engine, comprising the steps of:

detecting a high load state of the engine from the engine running condition, calculating an incremental fuel amount according to the engine running condition after the high load state is detected, deciding whether or not the incremental fuel amount exceeds a predetermined value, increasing the fuel injection amount to the extent of the incremental fuel amount when the incremental fuel amount does not exceed said predetermined value, gradually increasing the upper limit value of the incremental fuel amount at predetermined intervals, deciding whether or not the incremental fuel amount exceeds the upper limit value when the incremental fuel amount exceeds the predetermined value, increasing the fuel injection amount to the extent of the incremental fuel amount when the incremental fuel amount does not exceed the upper limit value and increasing the fuel injection amount with the upper limit value when the incremental fuel amount exceeds the upper limit value, and injecting the fuel on the basis of the above increased fuel injection amount.

Furthermore, according to the present invention, there is provided a fuel injection amount controlling apparatus for executing the above-mentioned methods for controlling the fuel injection amount.

According to the present invention, since the fuel injection amount is gradually increased in accordance with a predetermined incremental fuel amount when the load becomes high, the air/fuel ratio is controlled to be richer with an increase in combustion chamber temperature, thus suppressing the generation of knock. This is advantageous in that the durability of the engine is increased. Furthermore, since the air/fuel ratio can be kept leaner than the final air/fuel ratio for a long period until the incremental fuel amount is increased to the final incremental fuel amount, the fuel consumption efficiency can be greatly improved. Also, since the air/fuel ratio is made richer with an increase in the load, the period during which the air/fuel ratio approximates the power air/fuel ratio can be prolonged, and therefore a high output can be obtained during this period, thus assuring a good acceleration response. Furthermore, since the air/fuel ratio is controlled to be richer with an increase in the exhaust gas temperature, such an increase of the exhaust gas temperature can be suppressed, and as a result, the fuel consumption efficiency can be improved in comparison with the prior art.

DESCRIPTION OF THE PREFERRED EMBODIMENTS

An embodiment of the present invention will now be described.

Figure 1:
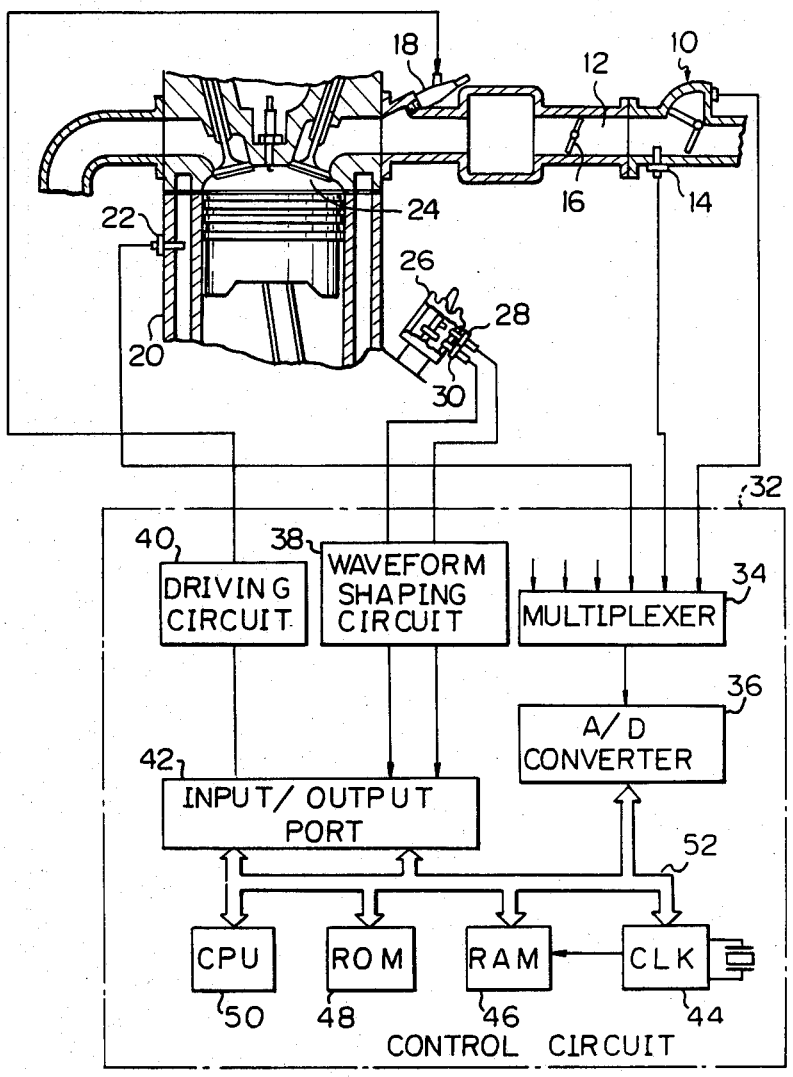
FIG. 1 is a schematic view of a fuel injection amount controlling apparatus according to an embodiment of the present invention.

FIG. 1 shows a fuel injection amount controlling apparatus of an internal combustion engine according to an embodiment of the present invention. Referring to FIG. 1, reference numeral 10 denotes an air flow sensor, provided in an air intake path 12, for generating a voltage in accordance with an intake air amount Q; 14 denotes an intake air temperature sensor, provided in the air intake path 12, for generating a voltage in accordance with an intake air temperature THA. A throttle valve 16 interlocking with an accelerator pedal (not shown) is provided in the air intake path 12 downstream of the sensors 10 and 14. A fuel injection valve 18 is provided, at an air intake path, also downstream of the valve 16.

A cooling water temperature sensor 22 for generating a voltage in accordance with a cooling water temperature THW is provided in a cylinder block 20 of an engine. Detection signals from the sensors 10, 14 and 22 are supplied to a control circuit 32.

A cylinder discriminating sensor 28 and a rotating angle sensor 30 are provided in a distributor 26. Pulse signals are generated from the sensor 28 at predetermined angular positions before the top dead center of a reference cylinder, e.g., every 360° crank angle (CA), and pulse signals are generated from the sensor 30 at every 30° CA. These pulse signals are supplied to the control circuit 32.

The control circuit 32 supplies a drive pulse to the fuel injection valve 18. Thus, the valve 18 intermittently injects compressed fuel supplied from a fuel supply system (not shown) into the air intake path 12 adjacent to a combustion chamber 24.

The control circuit 32 comprises a microcomputer which is mainly constituted by a central processing unit (CPU) 50, a random-access memory (RAM) 46, a read-only memory (ROM) 48, an input/output (I/O) port 42, a clock generator (CLK) 44, and a bus 52 for data transmission therebetween.

The detection signals from the sensors 10, 14, and 22 are sequentially selected by a multiplexer 34, and the selected signal is converted to a binary signal by an analog/digital (A/D) converter 36 and supplied to the microcomputer.

The pulse signal from the sensors 28 and 30 are waveshaped by a waveform shaping circuit 38, and thereafter are supplied to the microcomputer through the I/O port 42.

When an injection pulse signal is supplied from the microcomputer to a driving circuit 40 through the I/O port 42, the signal is converted to a driving pulse and the valve 18 is energized, thus performing fuel injection.

The operation of the microcomputer will be explained with reference to the flow charts shown in FIGS. 2 to 4.

Figure 2:
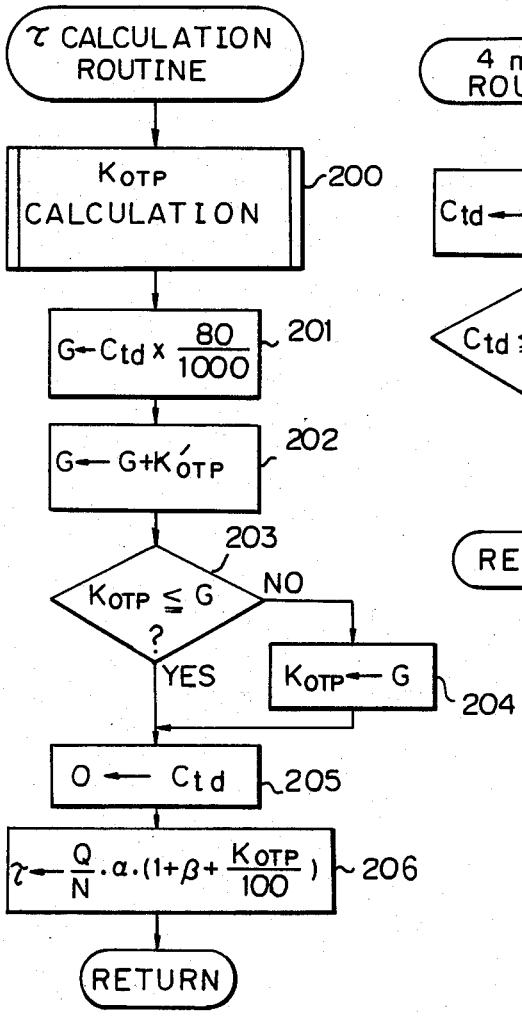
FIGS. 2, 3 and 4 are flow charts explaining one operation of a microcomputer in a control circuit provided in the apparatus shown in FIG. 1.

FIG. 2 shows a routine for calculating a fuel injection pulse width $\tau$, executed at every predetermined crank angle such as 360° CA.

In step 200, an incremental fuel amount $K_{OTP}$ is calculated from the engine speed N and the intake air amount Q. A calculation method thereof is shown in FIG. 4 and will be described later. Input data indicating the intake air amount Q is stored at a predetermined region in the RAM 46 together with input data indicating the cooling water temperature THW and the intake air temperature THA at each conversion operation by the A/D converter 36. In this case, the intake air amount per unit revolution Q/N corresponding to a load of the engine is calculated from the engine speed N and the intake air amount Q, and is stored in the RAM 46. The engine speed N can be obtained by a known method wherein a time interval during which the pulse signals from the sensor 30, i.e., at 30° CA, are applied is measured.

In steps 201 and 202, an upper limit value G of the incremental fuel amount $K_{OTP}$ is calculated. In step 201, the value G is set to be equal to a product $C_{td} \times (80/1{,}000)$ wherein the count value $C_{td}$ is increased by "1" at 4-msec intervals in the processing routine shown in FIG. 3. With this processing, the value G is increased by 20% per one second. In step 202, the value G is added to the incremental fuel amount $K'_{OTP}$ calculated in the previous routine, and thus a final upper limit value G is obtained.

Figure 3:
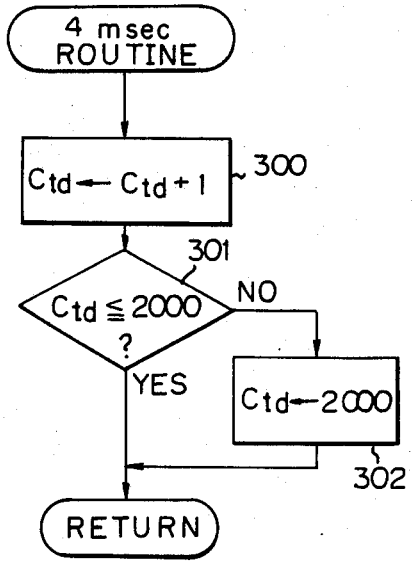

Note that, in the 4-msec interrupting routine of FIG. 3, in step 300, the count value $C_{td}$ is increased by "1", and in steps 301 and 302, the increased count value $C_{td}$ is controlled to be equal to or lower than 2,000.

In steps 203 and 204 of FIG. 2, the incremental fuel amount $K_{OTP}$ is controlled to be equal to or lower than the upper limit value G calculated as described above. In step 205, the count value Ctd is cleared.

In step 206, the injection pulse width $\tau$ is calculated from the intake air amount per unit revolution Q/N, the incremental fuel amount $K_{OTP}$ controlled to be equal to or lower than the upper limit value G, a correction coefficient $\beta$ corresponding to the cooling water temperature THW and the like, and another correction coefficient $\alpha$, i.e., calculated by equation;

$$\tau=(Q/N)\times\alpha\times(1+\beta+(K_{OTP}/100))$$

The calculated injection pulse width $\tau$ is temporarily stored in the RAM 46, and is then converted to the injection pulse signal in accordance with an injection controlling routine executed at the predetermined crank angle positions. Thereafter, the injection pulse signal is supplied to the driving circuit 40 through the I/O port 42.

Figure 4:
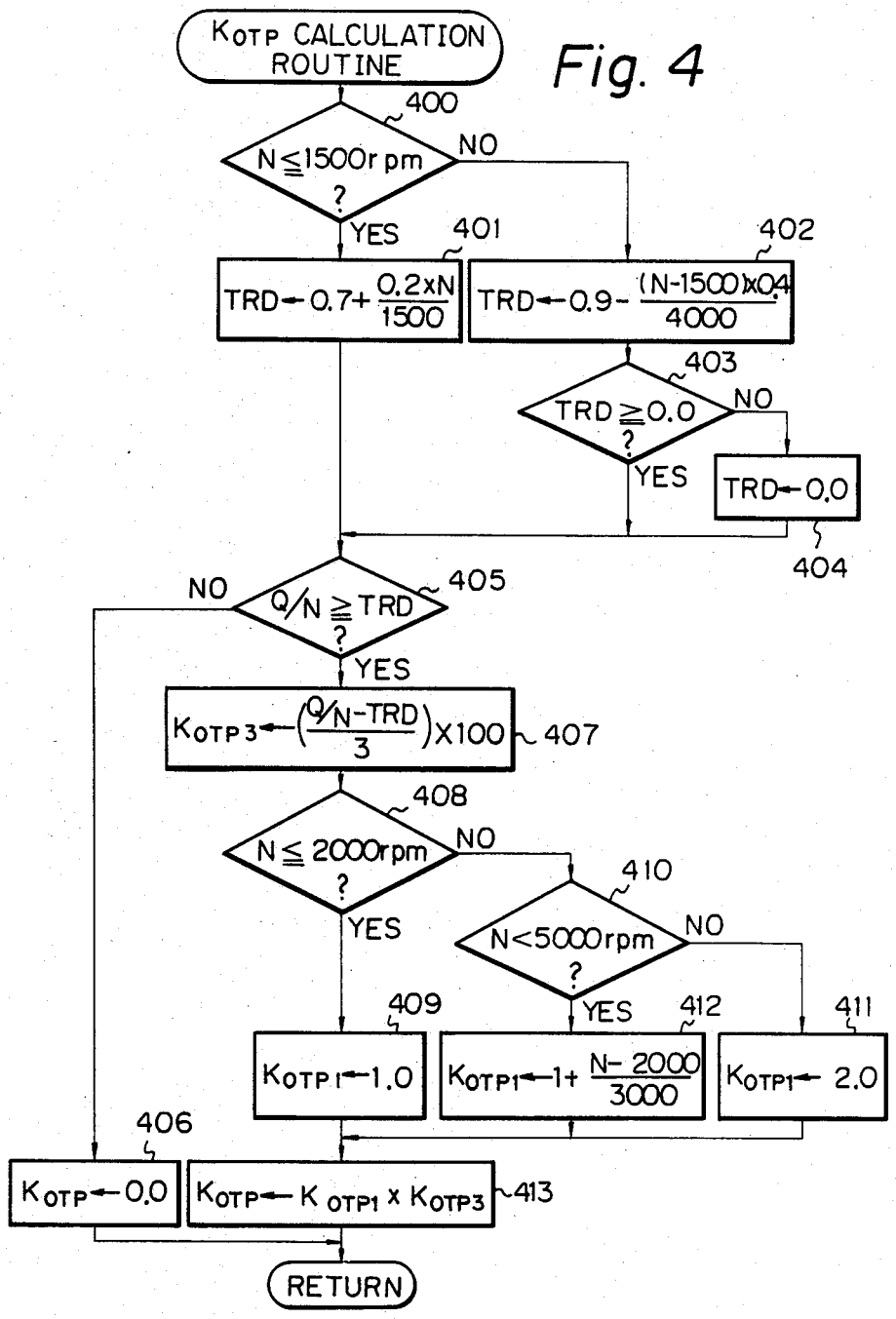
Figure 5:
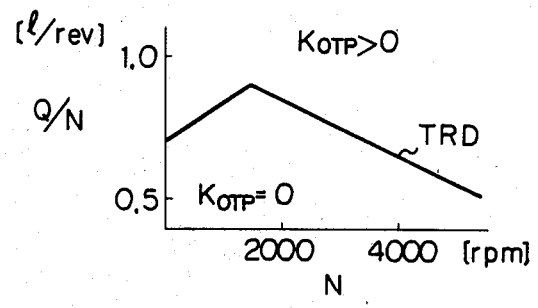
FIG. 5 is a graph showing an incremental fuel amount region in the high load state.

FIG. 4 shows the processing contents of step 200 in the processing routine of FIG. 2. In steps 400 to 404, a function TRD associated with the engine speed N and the intake air amount per unit revolution Q/N as shown in FIG. 5 is obtained. The function TRD indicates a point at which a decision is made as to whether or not the fuel injection amount is to be increased. Namely, when the amount Q/N is equal to or larger than the function TRD, the fuel injection amount is increased, and when the amount Q/N is smaller than the function TRD, the fuel injection amount is not increased. This decision is made in step 405. When Q/N<TRD, the flow advances to step 406, and the incremental fuel amount $K_{OTP}$ is set to 0.0, and thus the fuel injection amount is not increased.

Figure 6:
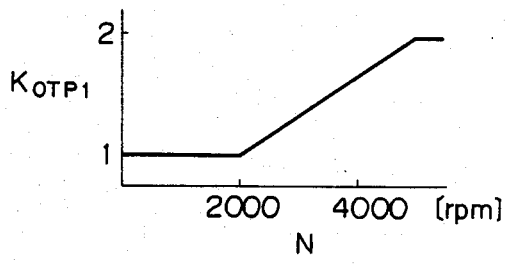
FIG. 6 is a graph showing the relationship between an engine speed N and an incremental fuel amount $K_{OTP1}$.
Figure 7:
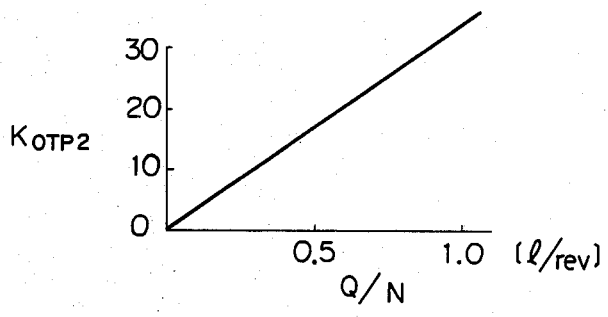
FIG. 7 is a graph showing the relationship between (intake air amount Q)/(engine speed N) and an incremental fuel amount $K_{OTP2}$.
Figure 8:
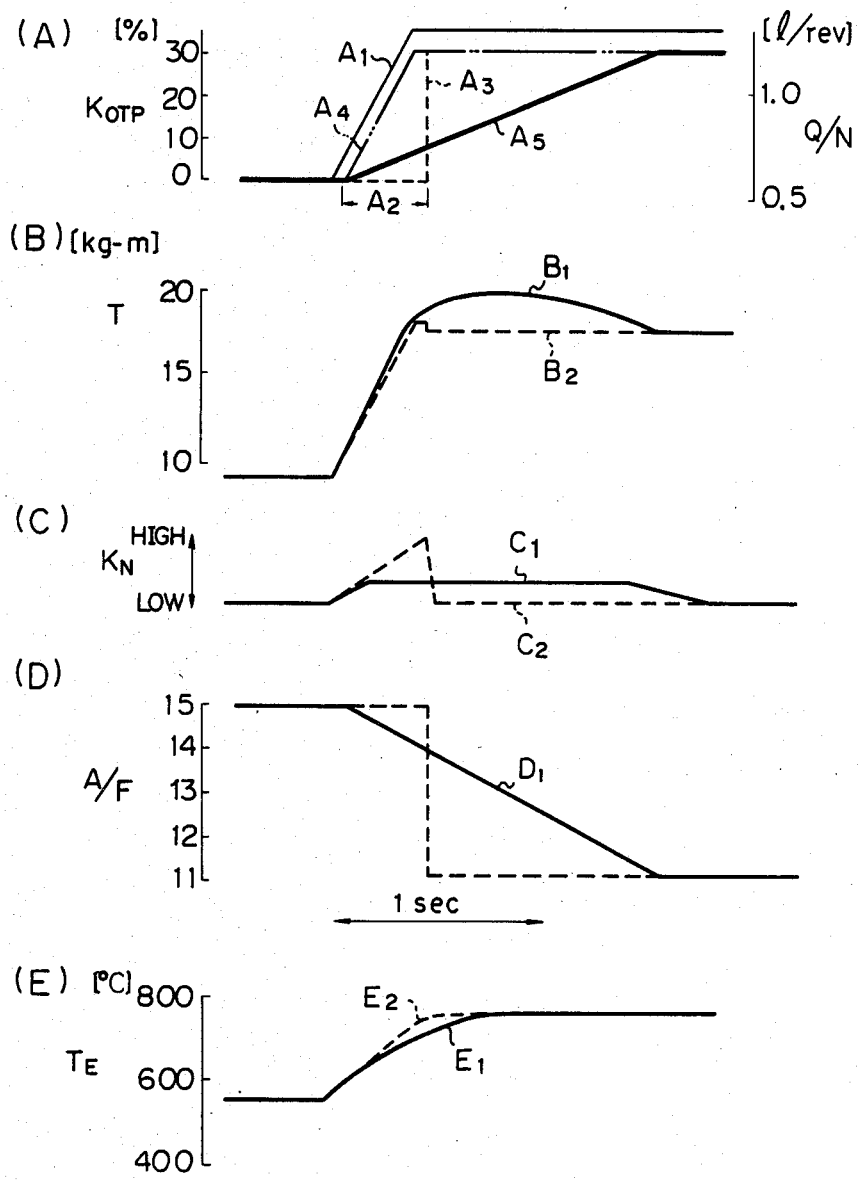
FIGS. 8(A) to 8(E) are graphs explaining an effect of the invention in the comparison with the prior art.

When Q/N≧TRD, the flow advances to step 407 to obtain an amount $K_{OTP3}$. The amount $K_{OTP3}$ is obtained from the amount $K_{OTP2}$ determined as corresponding to the amount Q/N as shown in FIG. 7 and the function TRD, i.e., calculated by the equation $K_{OTP3}=K_{OTP2}-(TRD/3)\times100=(Q/N-TRD)/3\times100$. In steps 408 to 411, the amount $K_{OTP1}$ corresponding to the engine speed N and having the relationship shown in FIG. 6 is obtained. In step 413, the incremental fuel amount $K_{OTP}$ is calculated by the equation $K_{OTP}=K_{OTP1}\times K_{OTP3}$. In this manner, the incremental fuel amount $K_{OTP}$ corresponding to the current engine running condition determined from the engine speed N and the intake air amount Q can be obtained in steps 407 to 413. It should be noted that the amount $K_{OTP}$ also can be directly obtained from a two-dimensional table of N and Q/N and the like in addition to the processing routine shown in FIG. 4.

Although in this embodiment the high load state is detected from N and Q/N, an intake air pressure or an opening degree of a throttle valve of the engine can be used as the high load state detecting means.

FIGS. 8(A) to 8(E) show an effect of the present invention described above in comparison with the prior art. In FIG. 8, the dotted lines correspond to the prior art and the solid lines correspond to this embodiment of the present invention.

As indicated by $A_1$ in FIG. 8(A), when the amount Q/N becomes large, in the prior art, the amount $K_{OTP}$ is increased stepwise as indicated by $A_3$ after the delay indicated by $A_2$. Conversely, in this embodiment, the amount $K_{OTP}$ is obtained by the processing routine as indicated by $A_4$ in accordance with an increase in the amount Q/N, and is controlled by the upper limit value G as indicated by $A_5$. Therefore, the final incremental fuel amount $K_{OTP}$ is gradually increased without the delay in accordance with an increase in the amount Q/N, as indicated by $A_5$. In this manner, since the amount $K_{OTP}$ is gradually increased in accordance with an increase in combustion chamber temperature, the air/fuel ratio A/F is gradually controlled to be richer, as indicated by $D_1$ in FIG. 8(D). As a result, as indicated by $C_1$ in FIG. 8(C), the knock generation level $K_N$ is greatly suppressed in comparison with $C_2$ of the prior art. Since the period when the air/fuel ratio is near the power air/fuel ratio of the engine is prolonged, an axial torque T indicated by $B_1$ in the FIG. 8(B) is considerably greater than the axial torque in the prior art indicated by $B_2$. Furthermore, since the air/fuel ratio A/F gradually becomes richer with an increase in the exhaust gas temperature $T_E$, the air/fuel ratio A/F is kept at the lean side from the final air/fuel ratio for a long time and, as indicated by $E_1$ in FIG. 8(E), the temperature $T_E$ is controlled to be lower than a temperature indicated by $E_2$ of the prior art. Therefore, the decrease in the exhaust gas temperature $T_E$ and the improvement in the fuel consumption efficiency can be achieved.

Figure 9:
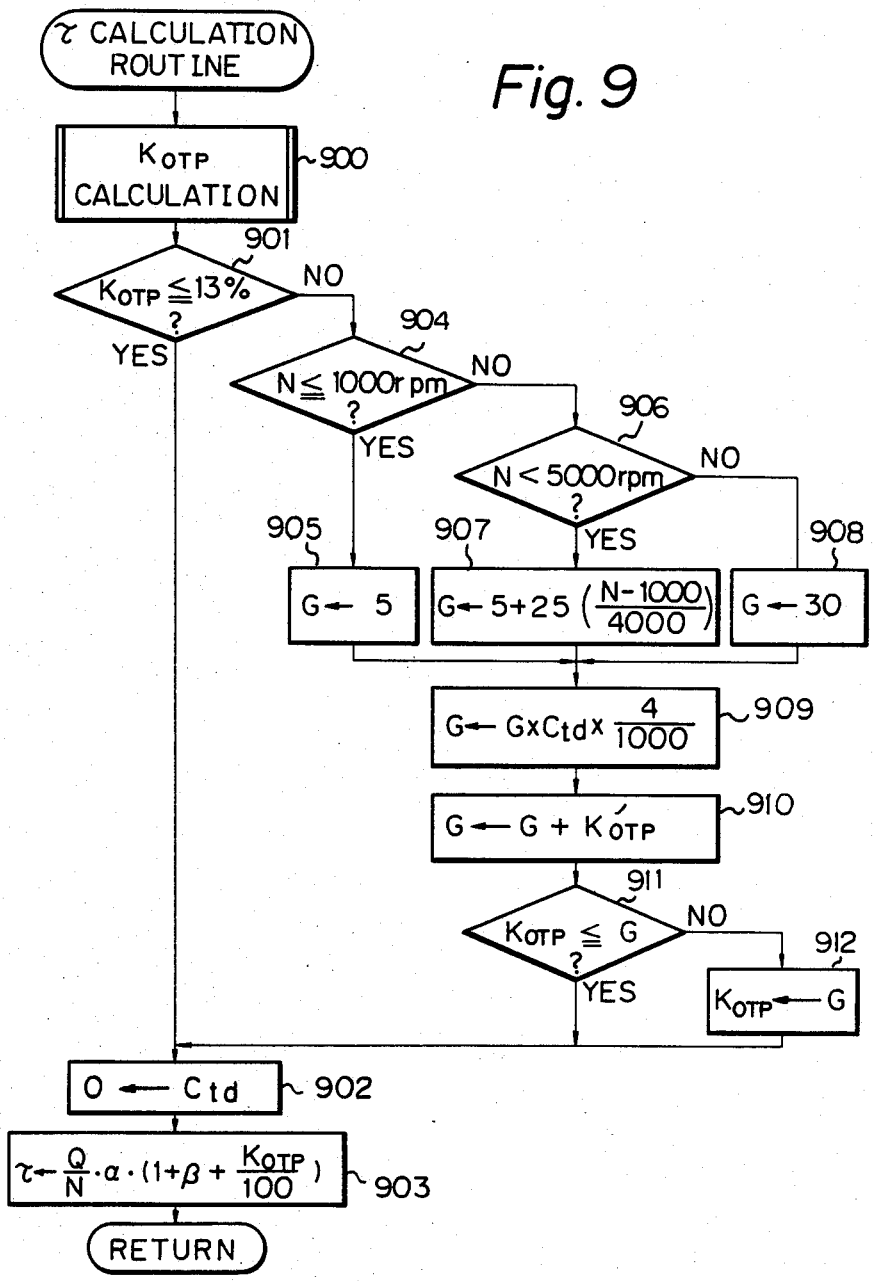
FIG. 9 is a flow chart explaining another operation of the microcomputer in the control circuit provided in the apparatus shown in FIG. 1.

FIG. 9 shows another calculation routine of the fuel injection pulse width $\tau$ according to the present invention.

Unlike the routine shown in FIG. 2, in this routine, the upper limit value G is changed in accordance with the engine speed N. Furthermore, when the incremental fuel amount $K_{OTP}$ is equal to or lower than the power incremental fuel amount of the engine, the fuel injection amount is increased to the extent of the incremental fuel amount.

In step 900, the incremental fuel amount $K_{OTP}$ is obtained in accordance with the processing routine shown in FIG. 4 in the same manner as in step 200 of FIG. 2. It is decided in step 901 whether or not the incremental fuel amount $K_{OTP}$ obtained in step 900 is equal to or lower than the power incremental fuel amount at which the maximum power of the engine can be obtained (in this case, 13%). If it is decided in step 901 that the incremental fuel amount is equal to or lower than the power incremental fuel amount, i.e., $K_{OTP}\leqq13\%$, the flow advances to step 902. In step 902, the count value Ctd is cleared. Then, in step 903, the injection pulse width is calculated without controlling the amount $K_{OTP}$ by the upper limit value. Step 903 is the same as step 206 of FIG. 2.

Figure 10:
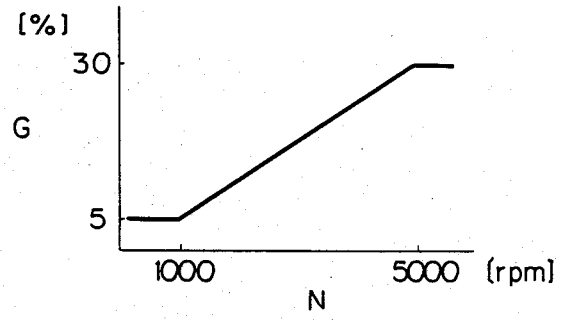
FIG. 10 is a graph showing the relationship between the engine speed N and the upper limit value G of the incremental fuel amount.

When the amount $K_{OTP}$ exceeds the power incremental fuel amount, steps 904 to 908 are executed, thereby obtaining the upper limit value G in accordance with the engine speed N. In steps 904 to 908, the value G in accordance with the engine speed N having the relationship shown in FIG. 10 is calculated.

In step 909, the upper limit value G is calculated from the count value $C_{td}$ increased by "1" at 4-msec intervals in the processing routine of FIG. 3 and the upper limit value G obtained in steps 904 to 908, i.e., calculated by the equation:

$$G=G\times C_{td}\times(4/1{,}000)$$

With this processing, the value G is increased by 1% per second (if the engine speed N is constant). The following steps 910 to 912 are the same as steps 202 to 204 of FIG. 2. Then, in step 902, the count value Ctd is cleared, and in step 903, the injection pulse width $\tau$ is calculated using the incremental fuel amount $K_{OTP}$.

In this manner, according to this processing routine, since the upper limit value G is controlled in accordance with the engine speed N, e.g., since the value G is controlled to be high when the engine speed N is high, the rate of increase of the incremental fuel amount in the high load state is changed in accordance with the engine speed N, as described above. Therefore, an optimum incremental fuel amount corresponding to an actual increase in the exhaust gas temperature can be obtained. Also, when the incremental fuel amount $K_{OTP}$ is equal to or lower than the power incremental fuel amount, the fuel injection amount is immediately increased to the extent of the current incremental fuel amount. Therefore, a period during which the air/fuel ratio is kept leaner than the power air/fuel ratio becomes short, and an increase in output can be expected immediately after the load becomes high.

Figure 11:
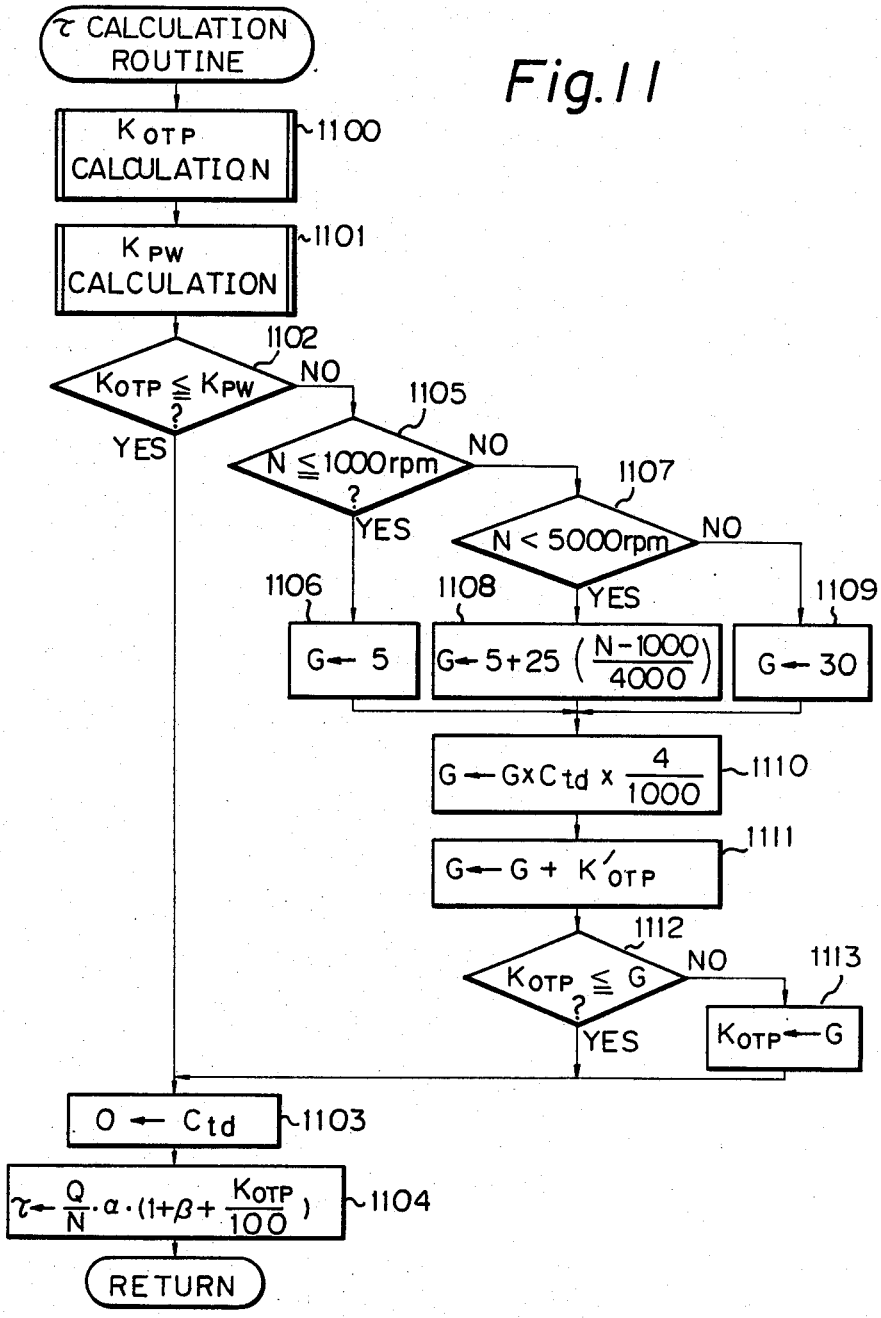

FIG. 11 shows still another calculation routine of the fuel injection pulse width $\tau$ according to the present invention. In this routine, unlike the routines shown in FIGS. 3 and 9, when the incremental fuel amount $K_{OTP}$ is equal to or lower than a predetermined value $K_{PW}$ controlled to be variable in accordance with the engine temperature, the fuel injection amount is increased to the extent of the corresponding incremental fuel amount.

In step 1100, the incremental fuel amount $K_{OTP}$ is calculated from N and Q/N, in accordance with the processing routine shown in FIG. 4.

In step 1101, the predetermined value $K_{PW}$ of the incremental fuel amount $K_{OTP}$ is calculated. The predetermined value $K_{PW}$ is changed in accordance with the cooling water temperature THW, and a calculation method thereof will be described later with reference to FIGS. 12 and 13.

In step 1102, the predetermined value $K_{PW}$ obtained in step 1101 is compared with the incremental fuel amount $K_{OTP}$. If $K_{OTP}$ is equal to or lower than $K_{PW}$ $K_{OTP} \leqq K_{PW}$), the flow advances to step 1103. In step 1103, the count value Ctd is cleared. Then, in step 1104, the injection pulse width $\tau$ is calculated using $K_{OTP}$ without controlling $K_{OTP}$ by the upper limit value G. In this case, the incremental fuel amount for the high load state can be quickly increased without delay.

However, if it is decided in step 1102 that $K_{OTP} > K_{PW}$, steps 1105 to 1109 are executed so that the upper limit value G of the incremental fuel amount is calculated in accordance with the engine speed N. In steps 1105 to 1109, the upper limit value G having the relationship shown in FIG. 10 is calculated.

In step 1110, the upper limit value G is calculated from the count value Ctd as shown in the processing routine of FIG. 3 and the upper limit value G obtained in steps 1105 to 1109, i.e., calculated by equation $$G = G \times C_{td} \times (4/1{,}000)$$

With this processing, the value G is increased by 1% per second (if the engine speed N is constant).

In step 1111, the value G obtained as described above is added to the incremental fuel amount $K'_{OTP}$ calculated in the previous routine, thus calculating the final upper limit value G. Then, in steps 1112 and 1113, the incremental fuel amount $K_{OTP}$ is controlled to be equal to or lower than the upper limit value G obtained as described above. Then, in step 1103, the count value Ctd is cleared, and the injection pulse width $\tau$ is calculated using the incremental fuel amount $K_{OTP}$, in step 1104.

As described above, when the amount $K_{OTP}$ exceeds the value $K_{PW}$, the amount $K_{OTP}$ is controlled to be equal to or lower than the upper limit value G, which is gradually increased, thereby delaying the fuel amount increment. Furthermore, since the upper limit value G is controlled in accordance with the engine speed N so that the value G becomes larger with an increase in the engine speed N, the rate of increase of the incremental fuel amount in the high load state is changed in accordance with the engine speed N, as described above. For this reason, the optimum incremental fuel amount corresponding to an increase in the exhaust gas temperature can be obtained. Furthermore, when the incremental fuel amount $K_{OTP}$ is equal to or lower than the predetermined value $K_{PW}$, the fuel injection amount is immediately increased to the extent of the current incremental fuel amount $K_{OTP}$. Therefore, a period during which the air/fuel ratio is kept leaner than the power air/fuel ratio can become short at a normal temperature, and an increase in output can be expected immediately after the load becomes high. Furthermore, as will be described later, since the predetermined value $K_{PW}$ is made large when the cooling water temperature THW is high, the fuel injection amount can be immediately increased to the extent of the high incremental fuel amount $K_{OTP}$ without delay when the cooling water temperature THW is high. As a result, the generation of knock can be satisfactorily eliminated.

Figure 12:
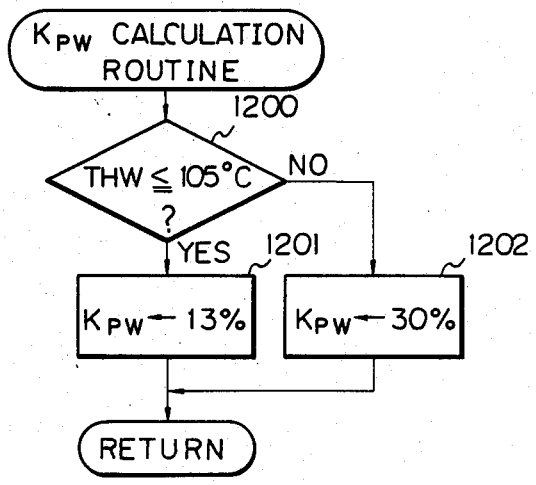
FIGS. 11, 12 and 13 are flow charts explaining still another operation of the microcomputer in the control circuit provided in the apparatus shown in FIG. 1.

FIG. 12 shows an example of calculation method of $K_{PW}$ in step 1101 of the routine shown in FIG. 11.

In step 1200, it is decided whether the cooling water temperature THW is equal to or lower than 105° C. If YES in step 1200, i.e., THW $\leqq$ 105° C., it is decided that the temperature THW is normal, and the flow then advances to step 1201. In step 1201, the power incremental fuel amount of the engine (in this embodiment, 13%) is set in the predetermined value $K_{PW}$. The incremental fuel amount immediately after starting the increase of the fuel injection amount for the high load state can be set to near the power incremental fuel amount, thereby prolonging the delay time. As a result, the air/fuel ratio can be kept to near the power air/fuel ratio for as long as possible, and the improvement in fuel consumption efficiency and an increase in output can be achieved. On the other hand, when THW > 105° C., it is decided that the cooling water temperature is high, and the flow advances to step 1202. In step 1202, a value much larger than the power incremental fuel amount, e.g., 30%, is set in the value $K_{PW}$. The incremental fuel amount immediately after starting the increase of the fuel injection amount for the high load state becomes large, and the air/fuel ratio becomes considerably rich immediately after starting the increase of the fuel injection amount, thus preventing the generation of knock.

Figure 13:
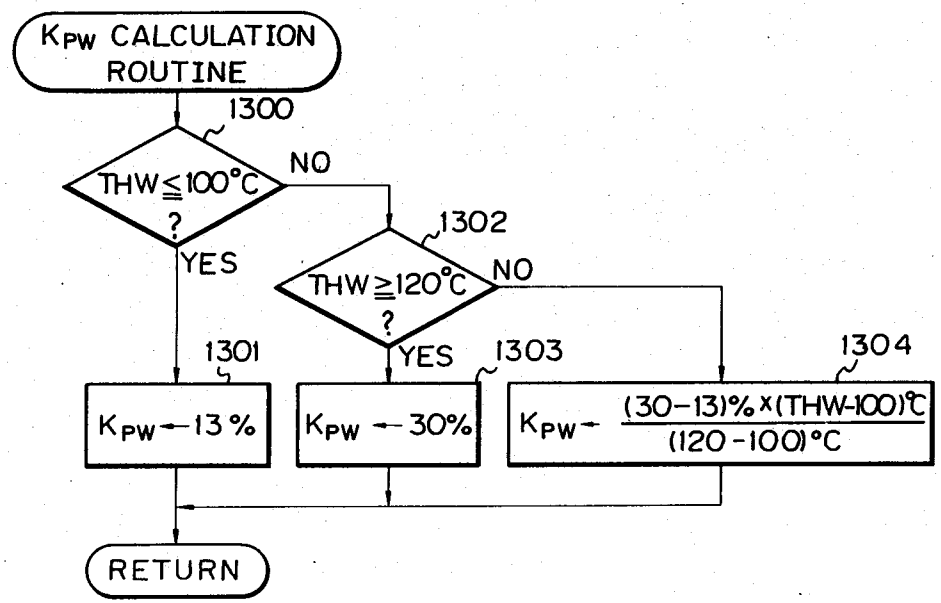

FIG. 13 shows another calculation method for the value $k_{PW}$ in step 1101 of the routine shown in FIG. 11.

In this case, when the temperature THW is equal to or lower then 100° C., the predetermined value $K_{PW}$ is set to 13% in step 1301. When THW > 120° C., the predetermined value $K_{PW}$ is set to 30% in step 1303. When 100° C. < THW < 120° C., the predetermined value $K_{PW}$ is set to be equal to a value which is linearly interpolated between 13% and 30% in step 1304. When the value $K_{PW}$ is controlled as shown in FIG. 13, the incremental fuel amount control can be precisely performed.

Note that in the above embodiment, although the value $K_{PW}$ is changed in accordance with the cooling water temperature THW, it also can be changed in accordance with other parameters indicating engine temperature such as oil temperature, cylinder block temperature or the like.

With the above processing routine, since the predetermined value $K_{PW}$ is changed in accordance with the engine temperature, knocking in the engine at a high engine temperature can be prevented, and an improvement in the fuel consumption efficiency and an increase in output of the engine at low engine temperatures can be achieved.

Figure 14:
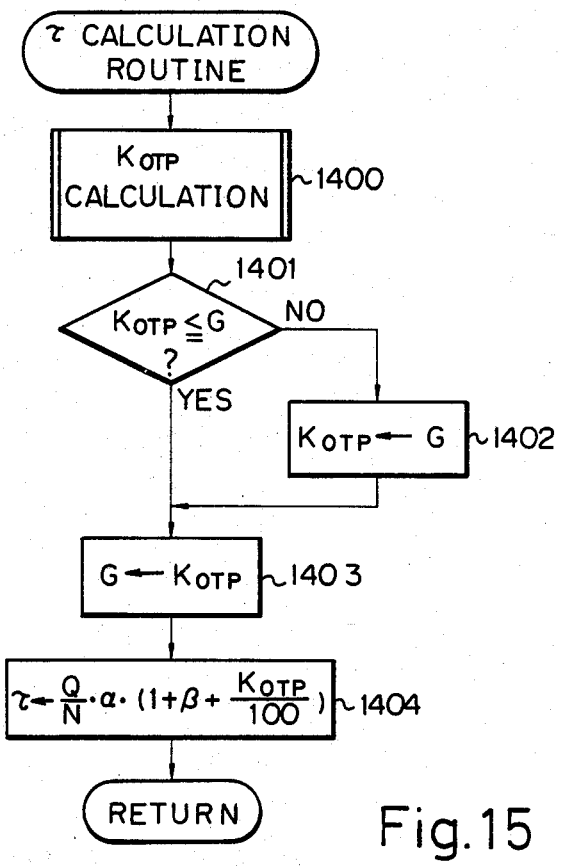
FIGS. 14 and 15 are flow charts explaining yet another operation of the microcomputer in the control circuit provided in the apparatus shown in FIG. 1.

FIG. 14 shows still another calculation routine of the injection pulse width $\tau$ according to the present invention. In this routine, the upper limit value G of the incremental fuel amount $K_{OTP}$ is increased at predetermined crank angles.

In step 1400, the amount $K_{OTP}$ is calculated in the same manner as in step 200 of FIG. 2 and in step 900 of FIG. 9. In steps 1401 and 1402, the amount $K_{OTP}$ is controlled to be equal to or lower than the value G in the same processing as in steps 203 and 204 of FIG. 2. In step 1403, the amount $K_{OTP}$ is set in the upper limit value G so as to prepare for calculation of the upper limit value G in the next routine. In step 1404, the injection pulse width $\tau$ is obtained in the same manner as in step 206 of FIG. 2.

Figure 15:
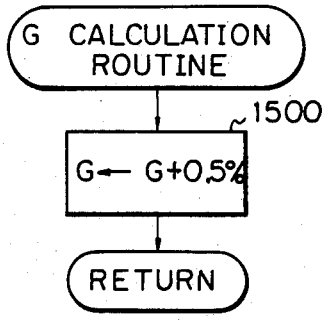

In this case, as shown in step 1500 of FIG. 15, the upper limit value G is increased by 0.5% by the processing routine executed at, for example, 120° CA. In the processing routine of FIG. 3, the upper limit value G is increased according to time. Conversely, in this routine, the upper limit value G is increased at predetermined crank angles.

Therefore, in this routine, the incremental fuel amount can be increased in synchronism with rotation of the crankshaft of the engine.

We claim:

1. A method for controlling a fuel injection amount in an internal combustion engine, comprising the steps of:

detecting a load of the engine;

determining whether said load is higher than a predetermined amount;

calculating a fuel quantity to be injected to the engine under a high load state in accordance with said load of the engine when said load of the engine is higher than said predetermined amount;

gradually increasing an upper limit value for said fuel quantity at predetermined intervals while said load of the engine is higher than said predetermined amount;

determining whether said fuel quantity exceeds said upper limit value;

adjusting said fuel quantity to said upper limit value only when said fuel quantity exceeds said upper limit value; and supplying an mount of fuel to the engine which is based on said fuel quantity.

2. A method according to claim 1, wherein said gradually increasing step includes increasing a rate of increase of said upper limit value according to an increase of the engine speed.

3. A method according to claim 1, wherein said gradually increasing step includes increasing said upper limit value at predetermined time intervals.

4. A method according to claim 1, wherein said gradually increasing step includes increasing said upper limit value at predetermined crank angles.

5. A method for controlling a fuel injection amount in a internal combustion engine, comprising the steps of:

detecting a load of an engine;

determining whether said load is higher than a predetermined amount;

calculating a fuel quantity to be injected to the engine under a high load state in accordance with said load of the engine when said load of the engine higher than said predetermined amount;

deciding whether said fuel quantity exceeds a predetermined value;

gradually increasing an upper limit value for said fuel quantity at predetermined intervals when said load of the engine is higher than said predetermined amount;

determining whether said fuel auantity exceeds said upper limit value only when said fuel quantity exceeds said predetermined value;

adjusting said fuel quantity to said upper limit value only when said fuel quantity exceeds said upper limit value; and supplying an amount of fuel to the engine which is based on said fuel quantity.

6. A method according to claim 5, wherein said gradually increasing step includes increasing a rate of increase of said upper limit value according to the increase of an engine speed.

7. A method according to claim 5, wherein a power incremental fuel amount of the engine is set in said predetermined value.

8. A method according to claim 5, further comprising the steps of detecting an engine temperature, and variably controlling said predetermined value according to said engine temperature.

9. A method according to claim 8, wherein said step of variably controlling said predetermined value includes increasing said predetermined value when said engine temperature is high.

10. A method according to claim 8, wherein said step of variably controlling said predetermined value includes setting a power incremental fuel amount in said predetermined value when said engine temperature is low.

11. A method according to claim 5, wherein said gradually increasing step includes increasing said upper limit value at predetermined time intervals.

12. A method according to claim 5, wherein said gradually increasing step includes increasing said upper limit value at predetermined crank angles.

13. An apparatus for controlling a fuel injection amount in an internal combustion engine, comprising:

means for detecting a load of the engine;

means for determining whether said load is higher than a predetermined load;

means for calcualting a fuel quantity to be injected to the engine under a high load state in accordance with said load of the engine when said load of the engine is higher than said predetermined load;

means for gradually increasing an upper limit value for said fuel quantity at predetermined intervals when said load of the engine is higher than said predetermined load;

means for determining whether said fuel quantity exceeds said upper limit value;

means for adjusting said fuel quantity to said upper limit value only when said fuel quantity exceeds said upper limit value; and means for supplying an amount of fuel to the engine which is based on said fuel quantity.

14. An apparatus according to claim 13, wherein said gradually increasing means is also for increasing a rate of increase of said upper limit value responsive to an increase of the engine speed.

15. An apparatus according to claim 13, wherein said gradually increasing means is also for increasing said upper limit value at predetermined time intervals.

16. An apparatus according to claim 13, wherein said gradually increasing means is also for increasing said upper limit value at predetermined crank angles.

17. An apparatus according to claim 16, wherein said gradually increasing means is also for increasing a rate of increase of said upper limit value responsive to the increase of the engine speed.

18. An apparatus according to claim 16, wherein a power incremental fuel amount of the engine is set in said predetermined value.

19. An apparatus according to claim 16, further comprising means for detecting an engine temperature and means for variably controlling said predetermined value according to said engine temperature.

20. An apparatus according to claim 19, wherein said predetermined value variable control means includes means for increasing said predetermined value when said engine temperature is high.

21. an apparatus according to claim 19, wherein said predetermined value variable control means includes means for setting a power incremental fuel amount of the engine in said predetermined value when said engine temperature is low.

22. An apparatus according to claim 16, wherein said gradually increasing means is also for increasing said upper limit value at predetermined time intervals.

23. An apparatus according to claim 16, wherein said upper limit value gradually increasing means is also for increasing said upper limit value at predetermined crank angles.

24. An apparatus for controlling a fuel injection amount in an internal combustion engine, comprising means for detecting a load of the engine;

means for determining whether load is higher than a predetermined amount;

means for calculating a fuel quantity to be injected to the engine under a high load state in accordance with said load of the engine when said load of the engine is higher than said predetermined amount;

means for determining whether said fuel quantity exceeds a predetermined value;

means for gradually increasing an upper limit value for said fuel quantity at predetermined intervals when said load of the engine is higher than said predetermined amount;

means for determining whether said fuel quantity exceeds said upper limit value only when said fuel quantity exceeds said predetermined value;

means for adjusting said fuel quantity to said upper limit value only when said fuel quantity exceeds said upper limit value; and means for supplying an amount of fuel to the engine which is based on said fuel quantity.

* * * * *